US007361014B2

(12) United States Patent
Hoffis et al.

(10) Patent No.: US 7,361,014 B2
(45) Date of Patent: Apr. 22, 2008

(54) INJECTION OF WASTE-DERIVED MATERIALS INTO PRE-CALCINING STAGE OF A CLINKER PRODUCTION SYSTEM

(75) Inventors: Lawrence L. Hoffis, Carmel, IN (US); Gregory J. Morical, Zionsville, IN (US)

(73) Assignee: Buzzi Unicem USA, Inc., Bethlehem, PA (US)

( * ) Notice: Subject to any disclaimer, the term of this patent is extended or adjusted under 35 U.S.C. 154(b) by 158 days.

(21) Appl. No.: 11/273,788

(22) Filed: Nov. 15, 2005

(65) Prior Publication Data

US 2007/0122762 A1 May 31, 2007

(51) Int. Cl.
*F27B 15/00* (2006.01)

(52) U.S. Cl. ..... 432/58; 432/13

(58) Field of Classification Search ..... 432/13–15, 432/58; 106/757, 759
See application file for complete search history.

(56) References Cited

U.S. PATENT DOCUMENTS 3,998,649 A * 12/1976 Gottlieb ..... 106/757
4,081,285 A 3/1978 Pennell
4,997,363 A * 3/1991 Hundebol ..... 432/14
5,989,017 A * 11/1999 Evans ..... 432/14
6,213,764 B1 4/2001 Evans
6,470,812 B1 10/2002 Arroyave-Garcia et al.
6,875,015 B1 4/2005 Tiernan

OTHER PUBLICATIONS

POLYSIUS, website http://www.polysiususa.com/HTML/Cement/Children/Calciner.asp, dated Jun. 22, 2005, 1 page.

* cited by examiner

*Primary Examiner*—Gregory A. Wilson
(74) *Attorney, Agent, or Firm*—Maginot, Moore & Beck

(57) ABSTRACT

A method for producing clinker in a system having a rotary kiln and a pre-calciner, waste material is introduced into the inlet end of the pre-calciner to serve as secondary fuel for pre-calcining raw mix also fed into the pre-calciner. The waste material is substantially completely combustible and exothermic. In a preferred embodiment, the waste material includes tires, plastics and other combustible waste that has been shredded or chipped to a size that is sufficiently small to ensure substantially complete combustion of the particles as they fall through the pre-calciner.

7 Claims, 1 Drawing Sheet

INJECTION OF WASTE-DERIVED MATERIALS INTO PRE-CALCINING STAGE OF A CLINKER PRODUCTION SYSTEM

BACKGROUND OF THE INVENTION

This invention relates in general to the manufacture of cement clinker, particularly in rotary kilns. More specifically, the invention relates to the introduction of waste materials into the clinker production process.

The details of a typical cement pyroprocessing operation are well known. One type of rotary kiln for manufacturing Portland cement is depicted in FIG. 1. Air and a primary fuel, such as coal, are injected into the rotary kiln 10 and are combusted to supply heat energy. Wet or dry raw materials, known as raw mix, for producing cement, such as limestone, clay and sand, are injected into the feed end 12 of the kiln. The kiln is inclined so that as the kiln rotates, the raw materials move through the kiln counter-current to the direction of the flow of the hot combustion gases so that the raw materials are subjected to progressively higher temperatures. For instance, at the input end, a pre-calcining zone can be provided that has a gas temperature of about 1000° F. (538° C.). The kiln gas temperature can be increased to about 1600° (871° C.) in a calcining zone where the $CaCO_3$ in the raw materials is decomposed. The calcined material then passes to a clinkering zone where it faces the burning zone temperature inside the kiln, approximately 2732° F. (1500° C.). It is in this zone that the feedstock is converted into the typical cement compounds, such as tricalcium silicate, dicalcium silicate, tricalcium aluminate, etc. A cooling zone follows at the output end 14 of the kiln. The resulting compound, or clinker, is later mixed with other materials, such as gypsum, and then finely ground to produce Portland cement.

In some clinker production facilities, a pre-calciner 20 is added at the feed end 12 of the kiln 10. A primary burner 26 and side burners 28 heat the gas within the pre-calciner and raise the temperature inside the vessel to approximately 860-900° C. The pre-calciner operates to dry, pre-heat and decarbonate (i.e. reduce the $CaCO_3$ to CaO and $CO_2$) the raw feed being provided to the kiln, which reduces the thermal load on the kiln and allows for the use of a shorter kiln tube. The pre-calciner 20 includes an inlet 22 for receiving raw materials and an outlet 24 for discharging combustion gas to appropriate conditioning equipment. In the typical facility, the raw materials introduced at the inlet 22 includes raw mix obtained from a hopper 30. As explained above, the raw mix includes calcaneous or clinker-forming materials, such as limestone.

It can be advantageous to burn waste materials in cement kilns, for several reasons. Such wastes would otherwise have to be disposed in a landfill or other long term containment, or incinerated as a means of destroying the materials. Landfill disposal typically is more expensive and less desirable than disposal by recovering the useful energy value of the waste. While these wastes provide energy to the kiln system, the kiln operator typically charges a "tipping fee", or service charge for accepting and disposing of the waste. The tipping fee is charged because there usually is a cost for handling and/or for pollution control associated with the use of diverse waste streams. Thus, use of waste-derived fuel in a cement kiln provides a benefit to the fuel user and to the waste generator. Namely, the kiln operator may gain significant income from tipping fees as well as fuel value that reduces the demand for conventional fossil fuels, and the waste generator may have access to a lower cost disposal option for the waste. The environment also benefits from use of waste as fuel, because cement kilns have efficient destructive capacity for various wastes as fuel and resultant fuel combustion products, due to high burning zone temperatures and long retention times of materials in the high temperature zone. Valuable landfill space is conserved, fossil fuels are conserved, and wastes that might have contaminated land or water are efficiently destroyed.

Types of waste that have been used as fuel or that have been recycled or processed in a variety of high temperature kiln situations, including cement kilns, according to the prior art include waste tires, either whole or when reduced in size by some means (U.S. Pat. No. 5,473,998); hazardous waste liquids, or solids or both (U.S. Pat. No. 5,454,333); agricultural waste, for example rice hulls; paper mill sludge (U.S. Pat. No. 5,392,721); soil, sludge, sand, rock or water contaminated with organic solvents and/or toxic metals (U.S. Pat. No. 4,921,538); sewage sludge (U.S. Pat. No. 5,217,624); petroleum refinery sludge (U.S. Pat. No. 5,141,526); various hazardous combustible wastes (see U.S. Pat. No. 5,454,333 or U.S. Pat. No. 4,984,983) and non-hazardous low-grade fuel wastes such as wood, paper and chemical waste (U.S. Pat. No. 5,336,317).

The usual locations for the input of fuel, air and raw mix are at the opposite ends of the kiln. In addition, flue gases escape at the elevated feed end of the inclined rotary kiln tube. Waste-derived fuel is sometimes added as a supplemental fuel at a mid-kiln location. The temperature at this mid-kiln location is high enough to assure substantially complete combustion of the waste so that the kiln can derive fuel value from the waste material. Waste type fuels that have been introduced at a mid-kiln location include hazardous waste materials, as disclosed in U.S. Pat. No. 6,050,203, and whole or shredded tires, as described in U.S. Pat. No. 6,213,764.

There is a consistent need to improve the efficiency and yield of the cement clinker production process. Moreover, there is a continuing over-riding need to efficiently dispose of waste of all types, including solid waste materials. These needs can merge into an over-arching goal of improving the manner in which waste and refuse materials are used in the production of cement clinker.

DESCRIPTION OF THE PREFERRED EMBODIMENTS

Figure 1:
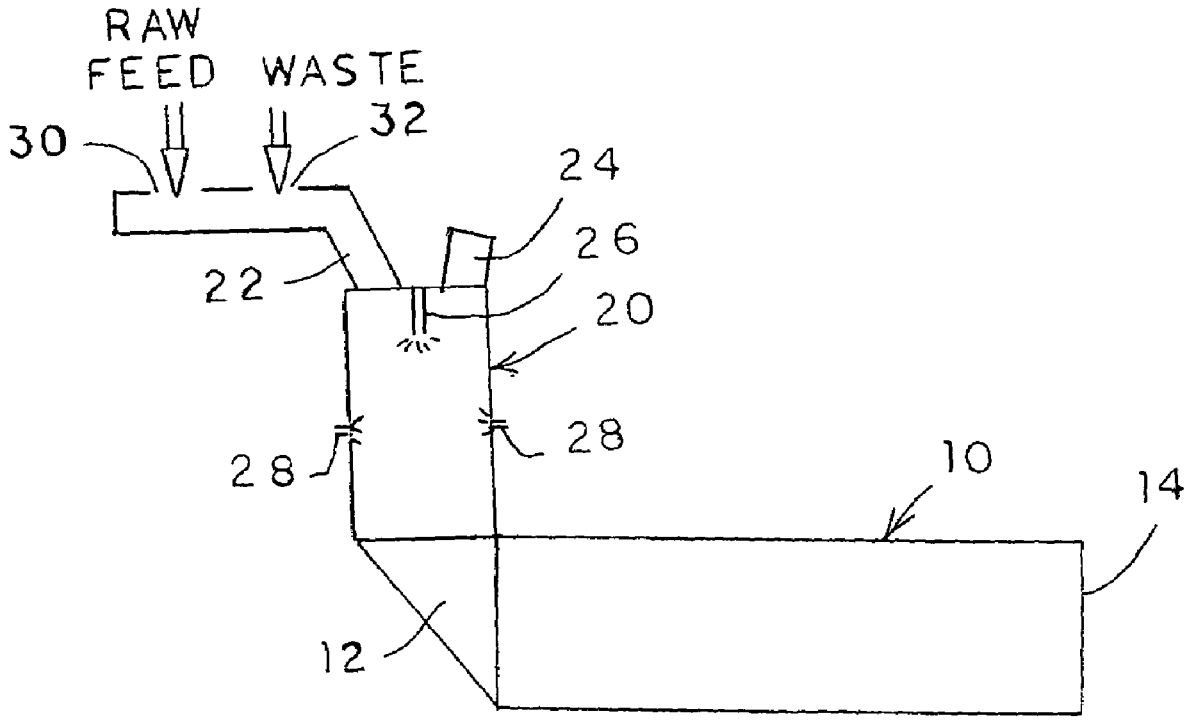
FIG. 1 is a schematic representation of a rotary kiln cement clinker production system suitable for implementing the methods of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

In accordance with one embodiment of the invention, waste or refuse materials are fed into the inlet 22 of the pre-calciner 20. The waste materials may be supplied through a hopper 32 that is separate from the raw mix hopper 30 described above. It is understood that the supply of both raw mix and waste material may be pre-heated in a conventional manner before being introduced into the pre-calciner 20. It is also contemplated that one or both of the raw mix and waste material may be introduced into the pre-calciner in other ways, such as by being blown into the vessel or by conveyor. However, in accordance with the present embodiment, a constant flow of either, but preferably both, of the materials is supplied to the pre-calciner.

In accordance with the preferred embodiment, the pre-calciner 20 is a vertical vessel so material passing through the vessel fall by gravity to the base of the pre-calciner. The vessel may be provided with a grate at the base of the vessel, although this component is not essential to practice the invention. The pre-calciner 20 may be of any known configuration and may be integrated with other upstream components that prepare the raw mix, such as cyclones and pre-heaters. The inlet 22 to the pre-calciner 20 may be modified as necessary to accept the raw mix from one source or through the upstream components, while also accepting the waste materials from a different source.

The invention entails the introduction of the waste material into the pre-calciner as fuel for the pre-calciner 20. In one embodiment, the waste material includes waste tires, and more particularly tires that have been chipped or shredded to a particle size or particle surface area that is sufficient to combust as the waste material falls through the pre-calciner. In one specific embodiment, the tire particles have a maximum dimension of about 100-150 mm so that the particles are substantially entirely combusted by the time the tire particles reach the inlet 12 of the rotary kiln 10. This combustion of the tire particles helps maintain a constant temperature in the pre-calciner and reduces the fuel requirements for that component. Under the present invention, any un-combusted tire particles or combustion by-products are small enough to pass directly into the kiln without any deleterious effects on the clinkering process or the final clinker product.

In the preferred embodiment, the waste material constitutes chipped or shredded tires reduced to a size of surface area that allows the material to substantially completely combust while falling inside the pre-calciner 20. However, other combustible waste materials are also contemplated provided the material can be appropriately sized. Thus, other suitable waste materials include certain plastics, carpet, creosote, certain rubber products such as conveyor belts, certain treated and untreated wood products, wood mill waste and other combustible waste. Combustion of the suitable materials must be exothermic to serve as a proper fuel for the pre-calciner. The dimension of these waste material particles depend upon the combustibility of the material. For instance, wood products are more combustible than tires so the size of waste wood fed into the inlet 22 of the pre-calciner can be much larger than the tire particles, limited of course by the size of the inlet itself, the waste material hopper 32 and the apparatus for conveying the material to the inlet.

Since the waste materials are intended as fuel for the pre-calciner, the material introduced into the vessel may be a mixture of a variety of waste materials. Preferably, the waste materials are introduced separate from the raw mix so that raw mix does not interfere with the complete combustion of the waste materials.

One benefit of the present invention is that no suspension components are required to suspend the secondary fuel—i.e., the waste material—within the pre-calciner 20. In prior systems, secondary fuel material are supported on a suspension component until the fuel has been adequately burned off. These systems require means for pushing the combustion residue off the suspension component before new secondary fuel material can be conveyed within the pre-calciner The present invention eliminates the need for this cumbersome system, thereby reducing the initial expense to construct the system. Further, the elimination of this prior system saves significant expense otherwise incurred to maintain such a system within the harsh environment of the pre-calciner. This continuous flow of waste material allows the pre-calciner to maintain a substantially constant temperature, in contrast to the temperature spikes experienced by the above-described prior systems. Another benefit of the present invention is that it allows for a constant, un-interrupted flow of the secondary fuel material through the pre-calciner. This continuous flow of waste material allows the pre-calciner to maintain a substantially constant temperature, in contrast to the temperature spikes experienced in prior suspension component systems.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A method for the production of cement clinker in a system having a heated kiln with a feed end for receiving raw mix and a vertical flow pre-calciner having an inlet end and an outlet end communicating with the feed end of the kiln, the pre-calciner operable to calcine raw mix falling by gravity from the inlet end of the pre-calciner into the feed end of the kiln, the method comprising the steps of:

introducing waste material into the inlet end of the pre-calciner, the waste material being exothermically combustible and sized to substantially completely combust while falling from the inlet end to the outlet end of the pre-calciner;

allowing all of the waste material to fall without support through the pre-calciner; and substantially completely combusting all of the waste material within the pre-calciner as the material falls from the inlet end to the outlet end.

2. The method of claim 1, wherein the waste material includes tires that have been reduced to a size sufficient to substantially completely combust within the pre-calciner.

3. The method of claim 1, wherein the residue from combustion of the waste material is introduced into the feed end of the kiln.

4. The method of claim 1, wherein the waste material is introduced into the inlet end of the pre-calciner independently of the raw mix.

5. The method of claim 1, wherein all un-combusted waste material is introduced into the feed end of the kiln.

6. The method of claim 1, wherein the waste material is introduced in a substantially uninterrupted continuous flow while raw mix is being fed to the pre-calciner.

7. The method of claim 6, wherein the flow of waste material is controlled to maintain a substantially constant temperature in the pre-calciner.

* * * * *